US011533963B2

(12) United States Patent
Gray et al.

(10) Patent No.: US 11,533,963 B2
(45) Date of Patent: Dec. 27, 2022

(54) STRAP FOR BACKLESS FOOTWEAR

(71) Applicant: Ghroov LLC, New Berlin, WI (US)

(72) Inventors: Blake Gray, New Berlin, WI (US); Courtney Voden, New Berlin, WI (US)

(73) Assignee: Ghroov LLC, New Berlin, WI (US)

( * ) Notice: Subject to any disclaimer, the term of this patent is extended or adjusted under 35 U.S.C. 154(b) by 0 days.

(21) Appl. No.: 16/397,684

(22) Filed: Apr. 29, 2019

(65) Prior Publication Data

US 2019/0328078 A1 Oct. 31, 2019

Related U.S. Application Data

(60) Provisional application No. 62/664,666, filed on Apr. 30, 2018.

(51) Int. Cl.
*A43B 13/12* (2006.01)
*A43B 3/12* (2006.01)
*A43C 11/00* (2006.01)

(52) U.S. Cl.
CPC ..... *A43B 3/122* (2013.01); *A43C 11/002* (2013.01)

(58) Field of Classification Search
CPC ..... A43B 1/0081; A43B 3/122; A43B 3/242; A43C 11/14; A43C 11/1493
See application file for complete search history.

(56) References Cited

U.S. PATENT DOCUMENTS 3,000,119 A 9/1961 Altman
3,336,683 A 8/1967 Schellkopf
4,672,722 A 6/1987 Malamed
4,914,843 A * 4/1990 DeWoskin ..... G09F 3/005 283/75
D336,358 S 6/1993 Hatfield
5,423,134 A * 6/1995 Bagnaia ..... A43B 3/128 36/101
5,463,823 A 11/1995 Bell et al.
RE35,452 E 2/1997 Sargeant
(Continued)

OTHER PUBLICATIONS

Lenderink Technologies, "Pressure Sensitive Adhesives Overlays and Backers", May 2016, https://web.archive.org/web/20160512031246/http://www.lenderink.com/dry-film-web-adhesives/pressure-sensitive/HOME PRODUCTS (Year: 2016).*
(Continued)

*Primary Examiner* — Sharon M Prange
(74) *Attorney, Agent, or Firm* — Andrus Intellectual Property Law, LLP

(57) ABSTRACT

A device for holding backless footwear on a person's foot includes an elongated seamless elastic strap, the strap extending in a longitudinal direction from a first end to a second end. First and second attachment mechanisms are disposed on the first and second ends of the strap, respectively. The strap can be attached to backless footwear having first and second portions on respective first and second lateral sides thereof by folding the first end of the strap around the first portion of the footwear and securing the first end to the strap between the first and second ends thereof by way of the first attachment mechanism, and by folding the second end of the strap around the second portion of the footwear and securing the second end to the strap between the first and second ends thereof by way of the second attachment mechanism.

9 Claims, 6 Drawing Sheets

(56) References Cited

U.S. PATENT DOCUMENTS

| | | | | |
|---|---|---|---|---|
| 5,657,557 | A | 8/1997 | Hull et al. | |
| 5,827,589 | A | 10/1998 | Autterson | |
| 5,992,058 | A | 11/1999 | Jnied | |
| 6,247,983 | B1 * | 6/2001 | Yeh | A63B 31/11 441/64 |
| 6,331,335 | B1 | 12/2001 | Autterson | |
| 6,435,926 | B1 * | 8/2002 | Yeh | A63B 31/11 441/64 |
| 6,516,538 | B2 | 2/2003 | Kraft | |
| 6,637,130 | B2 | 10/2003 | Urie et al. | |
| 6,651,359 | B1 | 11/2003 | Bricker | |
| 6,769,204 | B1 | 8/2004 | Phillips | |
| 7,132,144 | B2 | 11/2006 | Roberts | |
| 7,146,751 | B2 | 12/2006 | Seamans | |
| 7,168,189 | B2 | 1/2007 | Phelan | |
| 7,331,122 | B2 | 2/2008 | Januszewski et al. | |
| 7,614,126 | B2 | 11/2009 | Gerhardt | |
| 7,765,722 | B2 | 8/2010 | Berrins | |
| 8,122,519 | B2 | 2/2012 | Schmelzer et al. | |
| 8,220,184 | B2 | 7/2012 | Albert | |
| 8,230,621 | B2 | 7/2012 | Schmurak et al. | |
| 8,250,780 | B1 | 8/2012 | Diaz | |
| 8,353,116 | B2 | 1/2013 | Berrins | |
| 8,381,415 | B1 | 2/2013 | Lanoue et al. | |
| 8,935,859 | B2 | 1/2015 | Licht | |
| 9,386,824 | B1 | 7/2016 | Schultz | |
| 9,510,638 | B2 | 12/2016 | Mcdonald et al. | |
| 9,603,410 | B2 | 3/2017 | Mcnamara-Schwartz | |
| 9,788,595 | B1 | 10/2017 | Heaven | |
| 9,833,043 | B2 | 12/2017 | Ganci | |
| 2002/0114909 | A1 | 8/2002 | Aiello | |
| 2005/0039345 | A1 | 2/2005 | Jones et al. | |
| 2005/0120592 | A1 | 6/2005 | Rodrigues | |
| 2005/0252036 | A1 * | 11/2005 | Laska | A43B 3/122 36/11.5 |
| 2006/0156586 | A1 | 7/2006 | Brunelle-Wright | |
| 2007/0051016 | A1 | 3/2007 | Zorin | |
| 2007/0130800 | A1 | 6/2007 | Twomey | |
| 2007/0209235 | A1 | 9/2007 | Brunelle-Wright | |
| 2008/0155855 | A1 | 7/2008 | Klavano | |
| 2008/0168682 | A1 | 7/2008 | Le | |
| 2008/0235989 | A1 | 10/2008 | Agrawaz | |
| 2008/0276492 | A1 | 11/2008 | Burnett | |
| 2008/0295359 | A1 | 12/2008 | Jarosik | |
| 2008/0301860 | A1 | 12/2008 | Iqbal | |
| 2009/0313854 | A1 | 12/2009 | Clarke | |
| 2010/0064486 | A1 | 3/2010 | Hanlon | |
| 2010/0306902 | A1 | 12/2010 | Bourque | |
| 2011/0016751 | A1 | 1/2011 | Somerville | |
| 2011/0023330 | A1 | 2/2011 | Mcbride | |
| 2013/0047468 | A1 * | 2/2013 | Everett-Weber | A43B 13/189 36/87 |
| 2013/0326907 | A1 | 12/2013 | Ahanotu | |
| 2014/0190040 | A1 | 7/2014 | Yang | |
| 2014/0259763 | A1 | 9/2014 | Rady | |
| 2014/0305002 | A1 | 10/2014 | Murietta et al. | |
| 2014/0360054 | A1 | 12/2014 | Leslie et al. | |
| 2015/0033584 | A1 | 2/2015 | Ferguson | |
| 2015/0047228 | A1 | 2/2015 | Pernia | |
| 2015/0201715 | A1 | 7/2015 | Ogilvie | |
| 2015/0250271 | A1 | 9/2015 | Ogilvie | |
| 2015/0335094 | A1 | 11/2015 | Belshe et al. | |
| 2016/0015117 | A1 | 1/2016 | Kizer | |
| 2016/0113350 | A1 | 4/2016 | Sashen | |
| 2016/0249707 | A1 | 9/2016 | Lee | |
| 2016/0286894 | A1 | 10/2016 | Mcnamara-Schwartz | |
| 2016/0338448 | A1 | 11/2016 | Kenison | |
| 2016/0366981 | A1 | 12/2016 | Murdock, Jr. | |
| 2017/0099912 | A1 | 4/2017 | Kenison | |
| 2017/0238646 | A1 | 8/2017 | Newman | |
| 2018/0042342 | A1 | 2/2018 | Kleinsasser et al. | |

OTHER PUBLICATIONS

StarFlox LLC, "Strip Straps for Flip Flops," product website, available since at least 2014, https://www.strip-straps.com/products/stripstraps, website visited on Oct. 9, 2019.

Ginger Straps, "Why Ankle Straps," webpage, Jun. 27, 2018, available at https://web.archive.org/web/20180627192142/https://gingerstraps.com/pages/why-ankle-straps, last visited May 6, 2022.

* cited by examiner

STRAP FOR BACKLESS FOOTWEAR

CROSS-REFERENCE TO RELATED APPLICATION

The present application claims priority to and the benefit of U.S. Provisional Application No. 62/664,666, filed on Apr. 30, 2018, which is hereby incorporated herein by reference in its entirety.

FIELD

The present disclosure relates to footwear accessories, more specifically, to straps for securing backless footwear to a wearer's foot.

BACKGROUND

U.S. Pat. No. 3,336,683 discloses footwear, and more particularly, a convertible strap construction applied to footwear such as sandals, slippers, and the like, wherein the footwear may be worn either with an open back or with the support of a heel strap or sling.

U.S. Pat. No. 6,516,538 discloses a thin sandal made for reef and river walking utilizing a sponge-top layer directly fixed to a rubber sole as well as a single continuous adjustable elastic strap.

U.S. Pat. No. 8,381,415 discloses a flip-flop system featuring an elongated strap between about 6 to 10 inches in length; a first half snap disposed on the outer surface of the strap at the first end and a second half snap disposed on the outer surface of the strap near the first end, the first half snap can engage the second half snap by bending the first end of the strap around; and a third half snap disposed on the outer surface of the strap at the second end and a fourth half snap disposed on the outer surface of the strap near the second end, the third half snap can engage the fourth half snap by bending the second end of the strap around, the snaps function to the elongated strap to be removably attached to a flip-flop, sandal, or thong.

U.S. Patent Application Publication No. 2014/0305002 discloses a strap fastener configured for use with thong or flip flop style sandals. Sandal Savers wrap around a wearer's heel and connects by a hook to existing side straps extending from the toe divider post, adding a secure heel strap that prevents a sandal from sliding off one's foot. Each Sandal Saver is one piece, comprised of an elongated piece of stretchy elastic or comparable banding. To facilitate a firm and secure hold during wear, a button adjuster knob is secured over the toe strap center, allowing a user to loosen or tighten the strap as necessary.

U.S. Patent Application Publication No. 2015/0335094 discloses a heel attachment device for footwear is provided that includes an elastic section that can stretch in a longitudinal direction of the device. An attachment section is also present that is contiguous with the elastic section. The elastic section can stretch a greater amount in the longitudinal direction than the attachment section.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a device configured to hold backless footwear on a person's foot comprises an elongated elastic strap, the strap extending in a longitudinal direction from a first end to a second end. First and second attachment mechanisms are disposed on the first and second ends of the strap, respectively. The strap is seamless from the first end to the second end. The strap is configured to be attached to backless footwear having first and second portions on respective first and second lateral sides thereof by folding the first end of the strap around the first portion of the footwear and securing the first end to the strap between the first and second ends thereof by way of the first attachment mechanism, and by folding the second end of the strap around the second portion of the footwear and securing the second end to the strap between the first and second ends thereof by way of the second attachment mechanism.

According to another example of the present disclosure, a method for holding backless footwear on a person's foot comprises providing an elongated accessory strap, the accessory strap extending in a longitudinal direction from a first end to a second end and having first and second attachment mechanisms disposed on the first and second ends of the accessory strap, respectively. The method includes folding the first end of the accessory strap around a first portion on a first lateral side of the footwear and securing the first end to the accessory strap between the first and second ends thereof by way of the first attachment mechanism, and folding the second end of the accessory strap around a second portion on a second lateral side of the footwear and securing the second end to the accessory strap between the first and second ends thereof by way of the second attachment mechanism.

BRIEF DESCRIPTION OF THE DRAWINGS

Each example drawing is provided to explain how the device attaches to backless footwear and is not meant to limit the invention to use with variations in backless sandals. The devices disclosed herein could be used with other sandal or footwear variations.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Although the invention has been described in terms a specific embodiment, it will be readily apparent to those skilled in this art that various modifications, rearrangements, and substitutions can be made without departing from the spirit of the invention.

Backless sandals and footwear expose the wearer's heel and do not secure the heel to the footwear. While moving, the wearer's heel lifts off the bottom of the footwear because there is no securing device to hold the heel onto the backless sandal or footwear. This device will secure backless footwear to the wearer's heel and ankle with a seamless elastic strap folded around portions of the footwear and secured to itself with an adhesive such as transparent glue or pressure sensitive adhesive, or with a clear hook and loop fastener.

The present disclosure is of a strap accessory device for backless sandals, mules, wedge shoes, and backless boots used to hold such footwear onto a wearer's foot. Some existing footwear does not have a back strap and thus does not sufficiently hold the foot securely on/in the footwear. Backless footwear varieties expose the wearer's heel and do not secure the heel to the footwear. The wearer's heel at times is unattached from the footwear while moving, causing the wearer's heel to pull away from the backless footwear. In some cases, the backless footwear falls off the wearer's foot when sitting, crossing her legs, or walking. These problems occur especially with fancier or heavier sandals and shoes, which have more substance than does a beach flip-flop, and thus are more likely to fall off the wearer's foot. Therefore, the present attachable and removable strap is designed to hold a backless sandal more securely on the wearer's foot.

One footwear accessory device for a wearer's backless footwear according to the present disclosure is made of a seamless elastic strap provided with adhesive. In one example, the footwear accessory is comprised of a 4- to 12-inch long elongated seamless elastic strap that is ¼ inch to 2 inches in width and that can stretch around the heel or ankle of the foot. The strap attaches to backless footwear by way of adhesive adhered to the elastic strap. In other examples, hook and loop fasteners are used in addition to or instead of adhesive.

Figure 1:
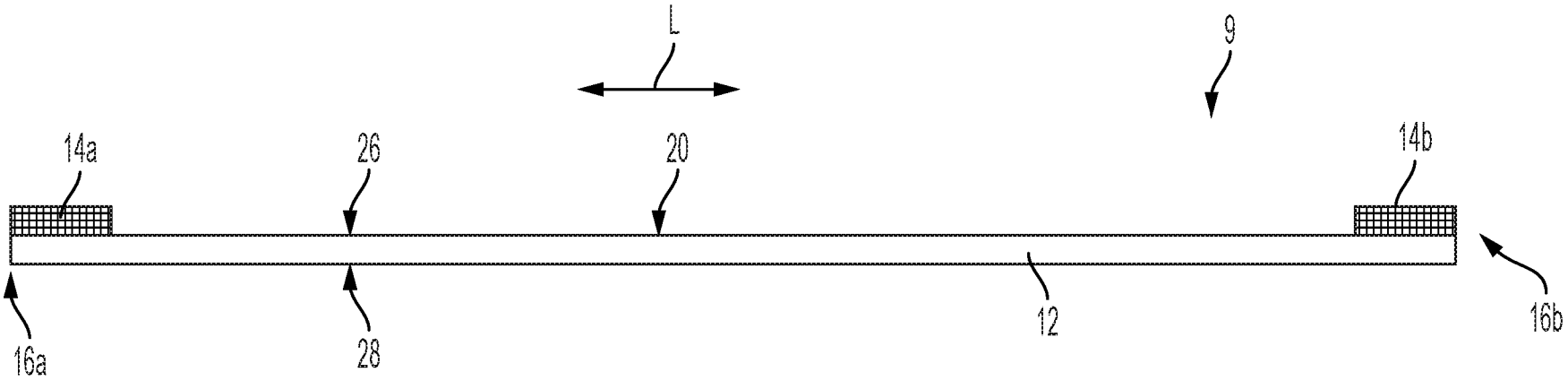
FIG. 1 is an elevation view of a device for use with backless footwear.
Figure 2:
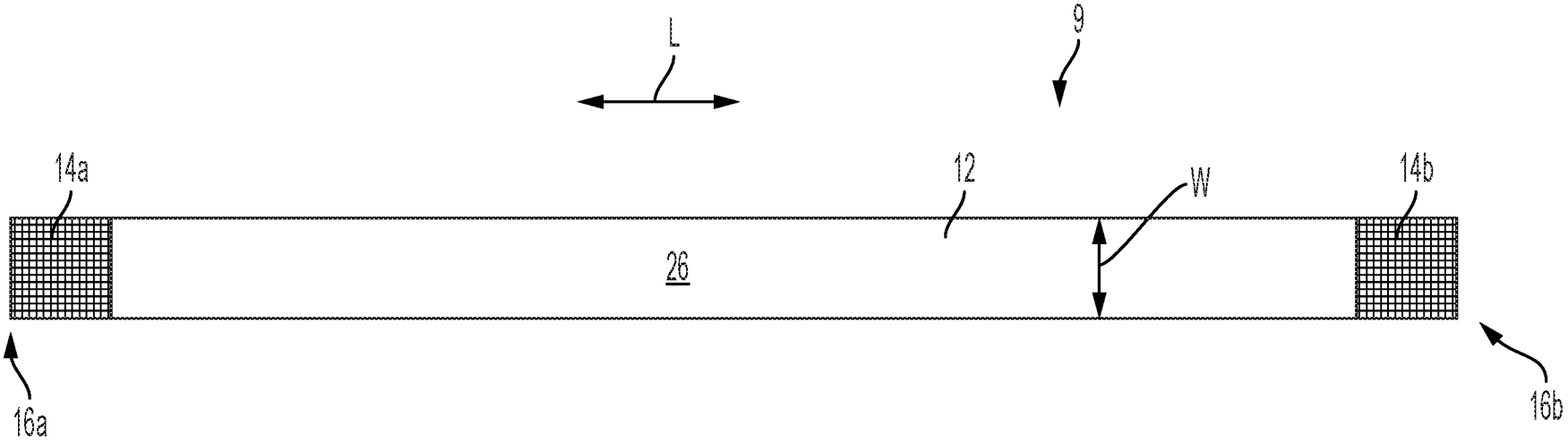
FIG. 2 is a plan view of the device.

As shown in FIGS. 1 and 2, a device 9 according to the present disclosure, which is configured to hold backless footwear on a person's foot, comprises an elongated elastic strap 12. The strap 12 extends in a longitudinal direction L from a first end 16*a* to a second end 16*b* and has a middle portion 20 there between. First and second attachment mechanisms 14*a*, 14*b* are disposed on the first and second ends 16*a*, 16*b* of the strap 12, respectively. According to the present disclosure, the strap 12 is seamless from the first end 16*a* to the second end 16*b*. This provides a smooth inner face 26 for touching the wearer's heel/ankle, and a smooth outer face 28 for aesthetic purposes. In one example, the strap 12 comprises thermoplastic polyurethane (TPU), such as polyester TPU. In one example, the strap 12 is 90A Shore A polyester TPU Film. For example, the strap 12 could be made of product number HD1301RDF sold under the trademark HDTAPE™ by Dongguan Yunze Garment Accessories Co., Ltd. of Guangdong, China. Alternative TPU tapes that could be used include FAMILON™ tape from Framis Italia Spa of Gaggiano, Italy or MOBILON™ tape from Sun Fashion Corp. of Osaka, Japan.

Figure 3:
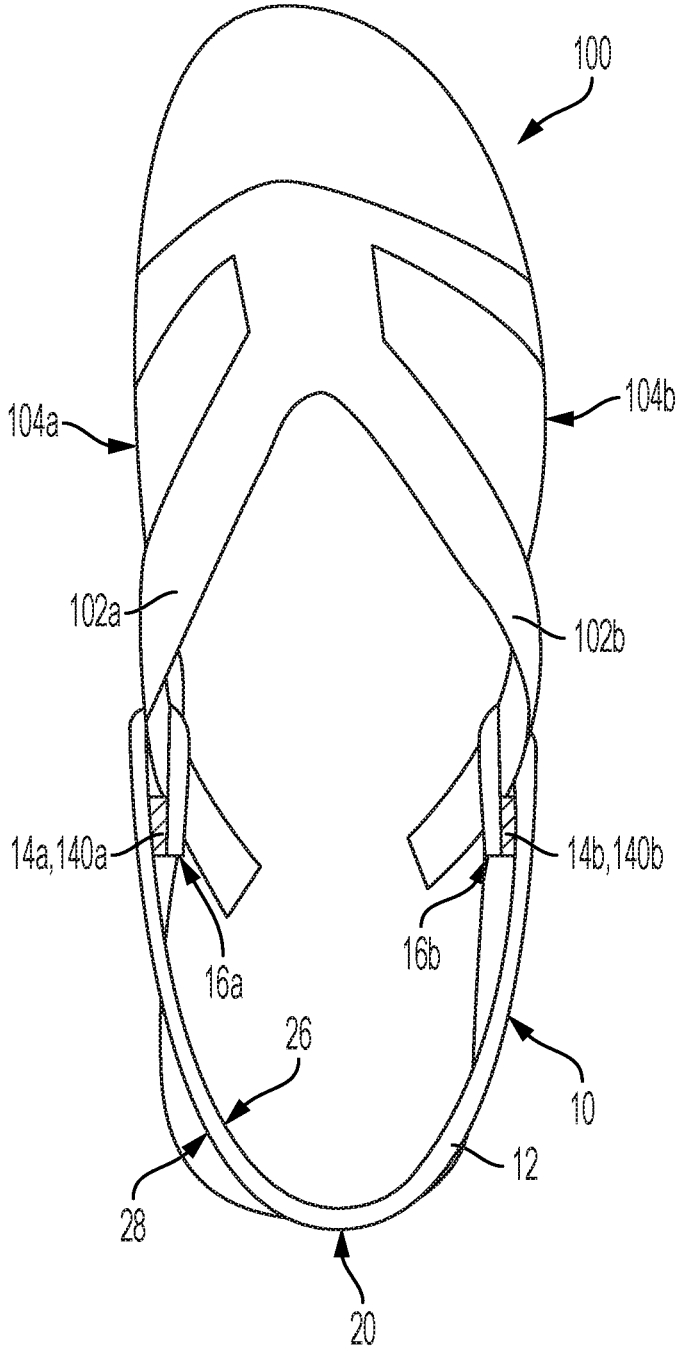
FIG. 3 is a top view of the device, showing how it would attach to a backless sandal.

Referring to FIG. 3, the strap 12 is configured to be attached to backless footwear 100 having first and second portions 102*a*, 102*b* on respective first and second lateral sides 104*a*, 104*b* thereof. In one example, the first and second portions 102*a*, 102*b* of the footwear 100 comprise left and right straps of the footwear. Such attachment is accomplished by folding the first end 16*a* of the strap 12 around the first portion 102*a* of the footwear 100 and securing the first end 16*a* to the strap 12 between the first and second ends 16*a*, 16*b* thereof by way of the first attachment mechanism 14*a*. Similarly, the second end 16*b* of the strap 12 is folded around the second portion 102*b* of the footwear 100 and the second end 16*b* is secured to the strap 12 between the first and second ends 16*a*, 16*b* thereof by way of the second attachment mechanism 14*b*. Specifically, the first end 16*a* of the strap 12 is folded around a rear portion of the left footwear strap 102*a*, and the second end 16*b* of the strap 12 is folded around a rear portion of the right footwear strap 102*b*. The first end 16*a* of the strap 12 is attached to the strap 12 between the first and second ends 16*a*, 16*b* thereof, but closer to the first end 16*a* than to the second end 16*b*. The second end 16*b* of the strap 12 is attached to the strap 12 between the first and second ends 16*a*, 16*b* thereof, but closer to the second end 16*b* than to the first end 16*a*. As a result, it can be seen that the ends 16*a*, 16*b* of the strap 12 are securely wrapped around the straps 102*a*, 102*b* of the footwear 100, with the middle portion 20 configured to extend behind the wearer's heel.

Referring back to FIG. 2, according to the present example, the strap 12 has a width W defined perpendicular to the longitudinal direction L. The first and second attachment mechanisms 14*a*, 14*b* each have a width that does not exceed the width W of the strap 12. This way, the strap 12 has an aesthetically pleasing outward appearance when it is in placed on footwear 100, as the first and second attachment mechanisms 14*a*, 14*b* are more or less hidden by the strap material on either side. This also prevents the first and second attachment mechanisms 14*a*, 14*b* from catching on the wearer's clothing or body, as well as prevents the first and second attachment mechanisms 14*a*, 14*b* from collecting dust or other debris from the ground.

Figure 4:
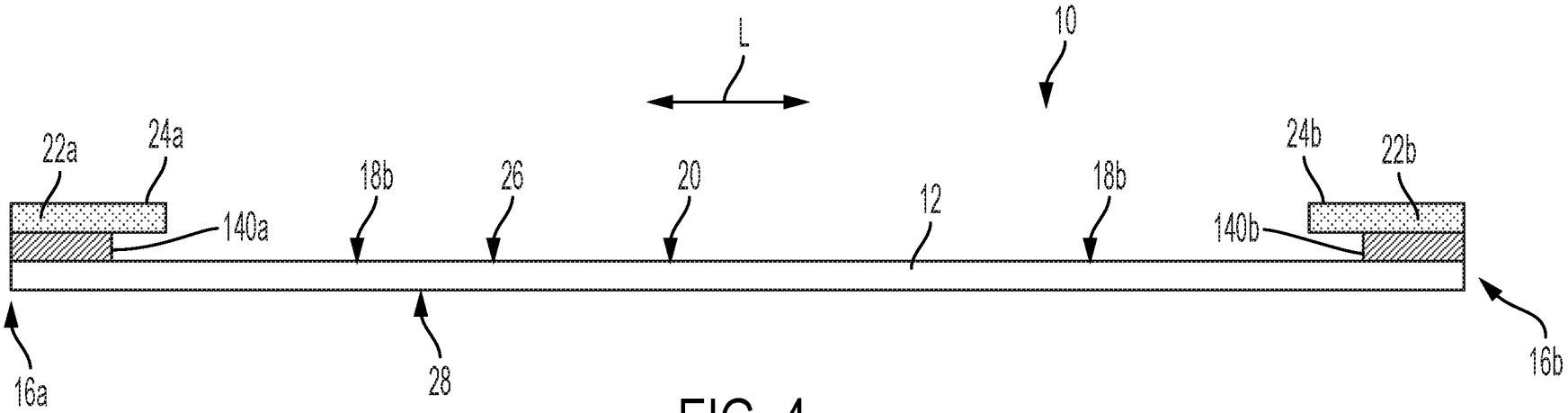
FIG. 4 is an elevation view of another example of a device according to the present disclosure.

In the example of FIG. 4, the first and second attachment mechanisms comprise adhesive. As shown, the device 10 comprises a single seamless elastic strap 12 with a layer of adhesive 140*a*, 140*b* on the inner face 26 of the strap 12 at each end 16*a*, 16*b* thereof. After the ends 16*a*, 16*b* of the strap 12 are wrapped around straps 102*a*, 102*b* of backless footwear 100, the adhesive 140*a*, 140*b* is used to secure the single continuous elastic strap 12 to itself on the inner face 26, such as at locations 18*a*, 18*b*. It should be understood that depending on the size of the wearer's foot, the locations 18*a*, 18*b* could be closer to the middle portion 20 of the strap 12. Alternatively, the adhesive 140*a*, 140*b* could be provided on the outer face 28 of the strap 12, and the ends 16*a*, 16*b* folded toward the outer face 28 to be secured thereto. The adhesive 140*a*, 140*b* could be applied in any shape, such as a rectangle, circle, oval, or square, and could be solid or in a hatched or checked pattern. Additionally, more than one area of adhesive 140*a*, 140*b* could be provided at each end 16*a*, 16*b* of the strap 12, such as two or three areas of adhesive at each end 16*a*, 16*b*. The adhesive 140*a*, 140*b* does not need to be applied directly at the ends 16*a*, 16*b* of the strap 12, but could instead be relatively proximate the ends 16*a*, 16*b*. In yet another example, the adhesive 140*a* could be provided on the inner face 26 of the strap 12, while the adhesive 140*b* could be provided on the outer face 28, or vice versa. Further, adhesive could be provided at both ends 16*a*, 16*b* on both the inner and outer faces 26, 28 of the strap 12 (at one or multiple locations) to provide the user with flexibility of choice when attaching the strap 12 to footwear 100.

In one specific example, the first and second attachment mechanisms are double-sided pressure-sensitive adhesive tape. The pressure-sensitive adhesive tape can be configured such that it cannot be removed from the first and second ends 16*a*, 16*b* of the strap 12. After pressure below a given threshold is applied to secure the first or second end 16*a* or 16*b* to the strap 12 via the first or second attachment mechanism, the first or second attachment mechanism is thereafter releasable from between the first and second ends 16*a*, 16*b* of the strap 12. This allows the wearer to test the fit of the strap 12 before more permanently connecting the first and second ends 16*a*, 16*b* to middle portion 20 of the strap 12. Once a desired fit is obtained, and after pressure above the given threshold is applied to secure the first or second end 16*a* or 16*b* to the strap 12 via the first or second attachment mechanism, the first or second attachment mechanism is thereafter not releasable from between the first and second ends 16*a*, 16*b* of the strap 12. One exemplary adhesive with these properties is CY93108 from 3M China Ltd. of Shanghai, China.

As shown in the elevation view of FIG. 4, the device 10 may be provided with removable protective sheets such as first and second release liners 22*a*, 22*b* over the adhesive 140*a*, 140*b* of the first and second attachment mechanisms, such that the wearer can remove the release liners 22*a*, 22*b* to expose the adhesive 140*a*, 140*b* there below, and thereafter adhere the ends 16*a*, 16*b* of the strap 12 to itself to secure the strap 12 on the backless footwear 100. The release liners 22*a*, 22*b* may be the same size as the adhesive 140*a*, 140*b*, or may be provided with overhangs 24*a*, 24*b* to make it easier to remove the release liners 22*a*, 22*b* from the adhesive 140*a*, 140*b*.

Referring again to FIG. 3, if the strap of FIG. 4 is used, the adhesive 140*a*, 140*b* at the ends 16*a*, 16*b* is adhered to the inner face 26 of the strap 12 between the first and second ends 16*a*, 16*b* (i.e., on the middle portion 20). (Clearly, the release liners 22*a*, 22*b* have already been removed from the strap 12 before this.) The adhesive 140*a*, 140*b* may be permanent or semi-permanent, such that a user would need to cut the strap 12 to remove it from the footwear 100. In another example, the pressure sensitive adhesive allows the ends 16*a*, 16*b* of the strap 12 to be removed from the inner face 26 of the strap 12 when greater than a threshold amount of force is applied to pull the ends 16*a*, 16*b* from the inner face 26.

As noted above, the two ends 16*a*, 16*b* may be secured around existing straps 102*a*, 102*b* of backless footwear 100 with clear fasteners such as the above-mentioned clear, transparent adhesive 140*a*, 140*b*. In the example described above, the adhesive is a pressure-sensitive adhesive. In another example, the adhesive becomes tacky when heated or when wet. For extra reinforcement, the strap ends 16*a*, 16*b* may alternatively or additionally be provided with transparent hook and loop fasteners, transparent snaps, and/or transparent buttons with corresponding button holes.

Figure 5:
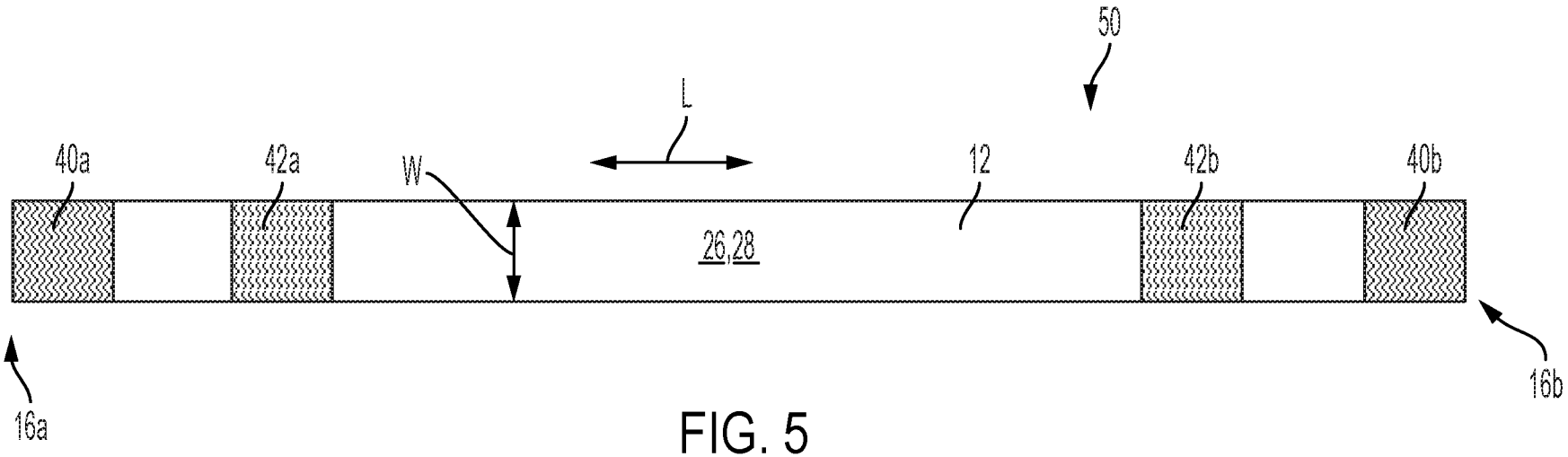
FIG. 5 is a plan view of another example of a device according to the present disclosure.

As shown in FIG. 5, in another example of the device 50, the first and second attachment mechanisms each comprise hook or loop fasteners 40*a*, 40*b*, which can be placed on the inner face 26 or the outer face 28 of the strap 12. The device 50 further comprises corresponding loop or hook fasteners 42*a*, 42*b* between the first and second ends 16*a*, 16*b* of the strap 12 for connection with the first and second attachment mechanisms. In this example, the hook and loop fasteners 40*a*, 40*b* and 42*a*, 42*b* may be applied to the inner face 26 or outer face 28 of the strap 12 with adhesive. The adhesive may be configured such that the hook and loop fasteners 40*a*, 40*b* and 42*a*, 42*b* are repositionable along the strap 12 such that a wearer can arrange them to achieve a desired fit of the strap 12 behind his or her heel. Alternatively, the hook and loop fasteners 40*a*, 40*b* and 42*a*, 42*b* can be permanently connected to the strap 12.

Figure 6:
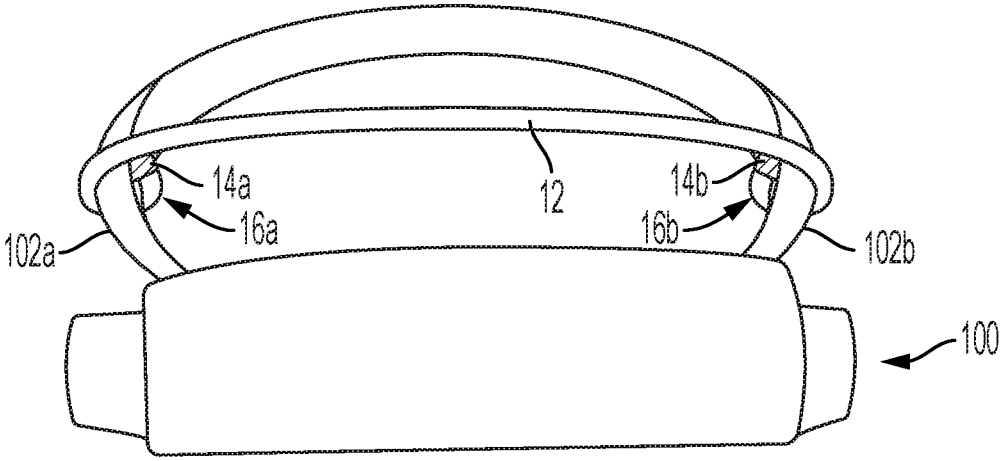
FIG. 6 is a back view of the device of FIGS. 1 and 2, showing how it would attach to a backless sandal.
Figure 7:
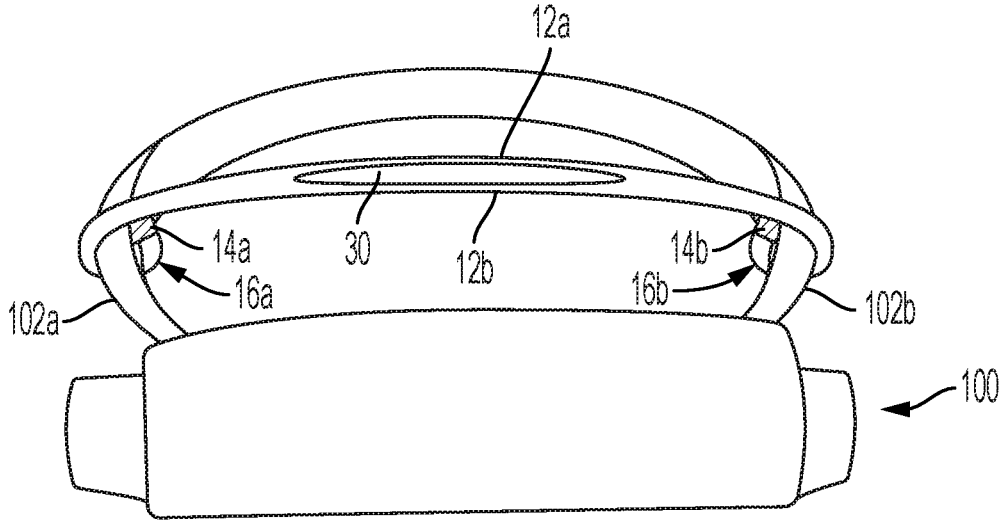
FIG. 7 is a back view of another embodiment of a device according to the present disclosure, showing how it would attach to a backless sandal.

FIG. 6 shows a rear view of the footwear 100 having straps 102*a*, 102*b* to which the strap 12 is attached. FIG. 7 shows a rear view of the footwear 100, but this time with a strap having a split 30 extending longitudinally with respect to the strap, and dividing it into first strap segment 12*a* and second strap segment 12*b*. Such a split 30 allows the strap segments 12*a*, 12*b* to be placed at higher and lower spots on the wearer's ankle/heel, thus providing a more secure fit and spreading out the application of force on the wearer's ankle/heel. Note that the strap segments 12*a*, 12*b* need not be thinner than the reminder of the strap 12, but could instead have widths that are the same as the remainder of the strap 12.

The various elastic materials used for the strap 12 may be invisible to the user. Thus, the strap 12 may be clear and colorless, transparent, translucent, or various flesh tones. In other examples, the strap 12 is a color that suits a wearer's mood or matches the backless sandal. Such a strap could be transparent, translucent, or opaque. In one example, the strap 12 is a non-knit, non-woven material made of silicone, polyurethane, or the like, or composites thereof. Any of the above-noted embodiments of the strap 12 could have jewels, beads, sequins, glitter, or other decorations thereon. A logo or other indicia may be provided on the elastic strap 12 to identify authenticity of the device, such as by printing, stamping, embossing, or other methods. For decorative purposes, different images could be stamped onto the strap such as dots, stars, emoji, diamonds, cats, dogs, etc.

Figure 8:
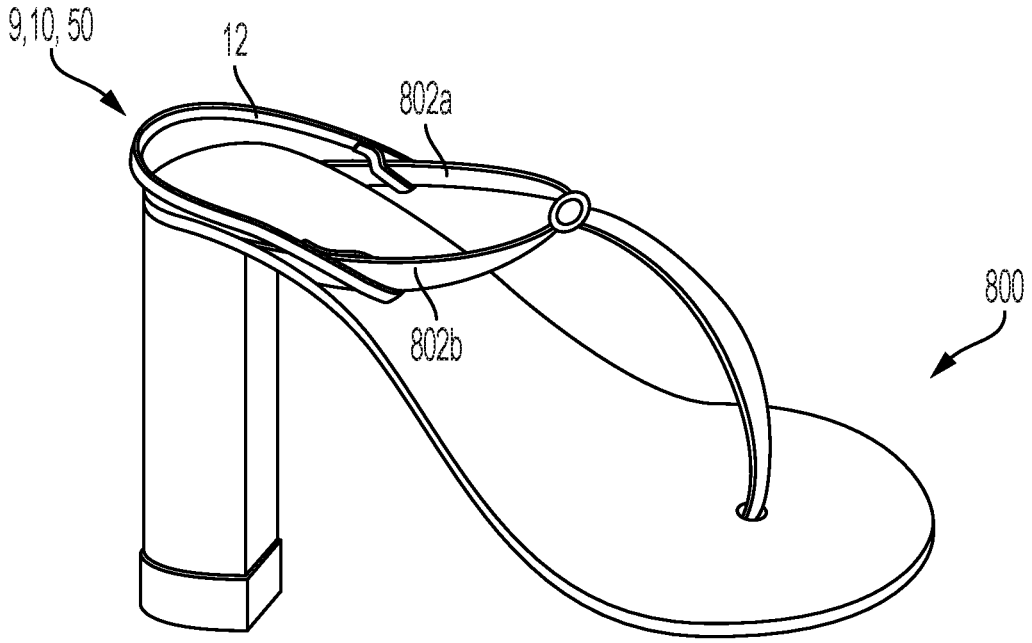
FIG. 8 shows a high-heeled sandal with which the devices of the present disclosure can be used.

The device 9, 10, 50 may be attached to footwear 100, 200 lacking sufficient attachment of the heel, including, but not limited to, a backless sandal, boot, mule, wedge-healed shoe, high-healed shoe, or stiletto. For example, FIG. 8 shows a high-heeled backless sandal 800 having straps 802*a*, 802*b* around which the strap 12 of the present disclosure could be situated.

The device 9, 10, 50 may be ¼" to ⅜" in width, or ¼" to 1" in width +/−10%. The device 9, 10, 50 may be solid (FIG. 6) or split (FIG. 7). The device 9, 10, 50 may have a certain degree of thickness, not limited to 1/16" to ¼" +/−10%. It should be understood that the elevation views of FIGS. 1 and 4 show the strap 12, attachment mechanisms 14*a*, 14*b*, adhesive 140*a*, 140*b*, and release liners 22*a*, 22*b* with exaggerated thicknesses in order to illustrate the present disclosure. In reality, the attachment mechanisms 14*a*, 14*b*, adhesive 140*a*, 140*b*, and release liners 22*a*, 22*b* are only millimeters thick.

The device 9, 10, 50 may come in several lengths: small, medium, large, extra large, shoe size 1-2-3-4-5-6-7-8-9-10, or one-size-fits-all. The strap 12 may be anywhere between about 3 inches and about 11 inches in length measured from the first end 16*a* to the second end 16*b*. Because the strap 12 is elastic, it can be stretched to a longer length to allow the wearer to place his or her foot into the footwear 100, after which it can return to its original length to secure to the heel.

The device 9, 10, 50 may be provided/sold in pairs, in which case the straps are interchangeable between the left and right footwear article.

The device 9, 10, 50 may be attached to the footwear 100, 200 before the wearer places her foot into the footwear 100, 200 or while the wearer is wearing the footwear 100, 200. The device 9, 10, 50 may be positioned on the heel, above the heel or at or near the back of the ankle. The device 9, 10, 50 is worn at the back of the heel or ankle and directly touches the skin of the wearer's foot.

Figure 9:
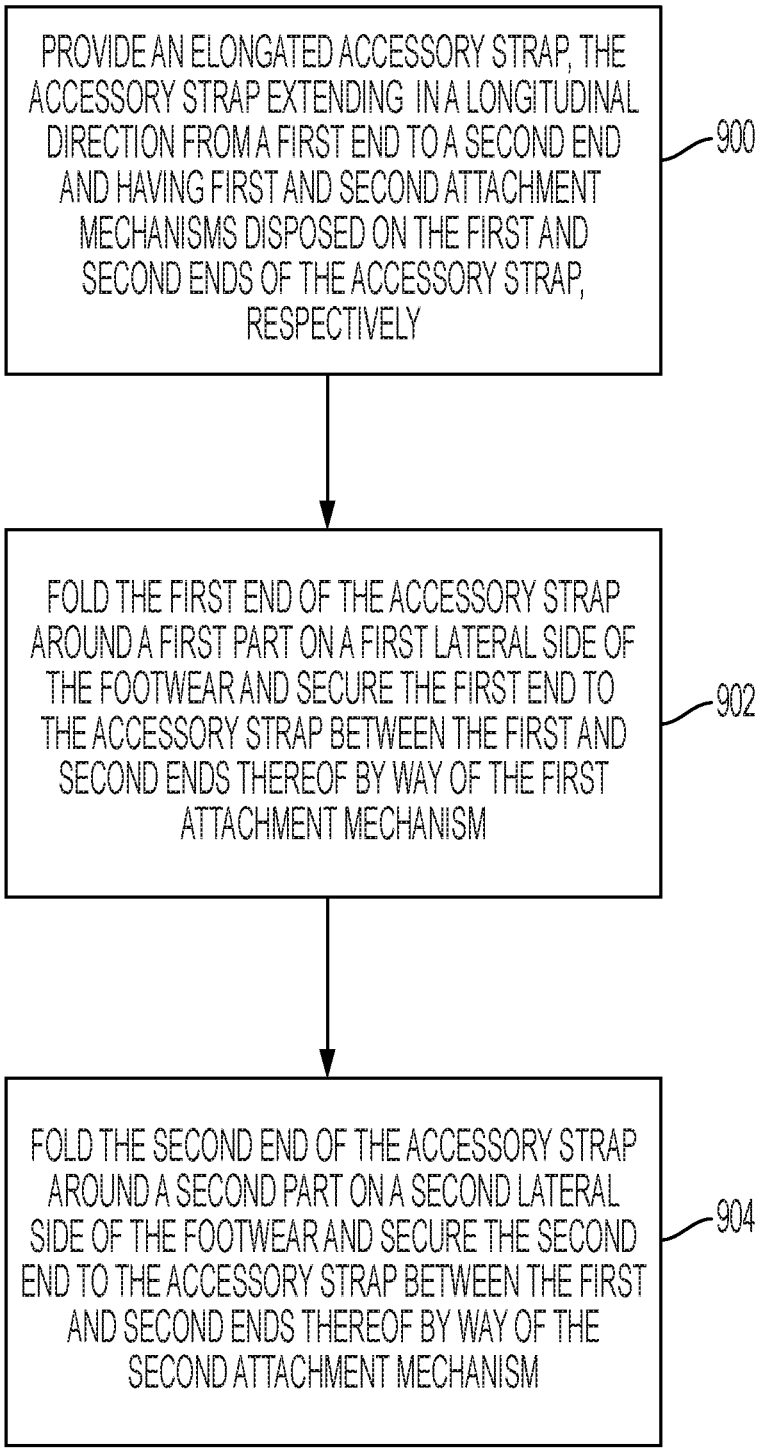
FIG. 9 illustrates a method for holding backless footwear on a person's foot.

In one example, as shown in FIG. 9, a method for holding backless footwear 100 on a person's foot comprises providing an elongated accessory strap 12, the accessory strap 12 extending in a longitudinal direction L from a first end 16*a* to a second end 16*b* and having first and second attachment mechanisms 14*a*, 14*b* disposed on the first and second ends 16*a*, 16*b* of the accessory strap 12, respectively, as shown at 900. The method includes folding the first end 16*a* of the accessory strap 12 around a first portion 102*a* on a first lateral side 104*a* of the footwear 100 and securing the first end 16*a* to the accessory strap 12 between the first and second ends thereof by way of the first attachment mechanism 14*a*, as shown at 902. The method also includes folding the second end 16*b* of the accessory strap 12 around a second portion 102*b* on a second lateral side 104*b* of the footwear 100 and securing the second end 16*b* to the accessory strap 12 between the first and second ends thereof by way of the second attachment mechanism 14*b*, as shown at 904.

Furthermore, the method may include placing the foot in the footwear 100 prior to securing at least one of the first and second ends 16*a*, 16*b* to the accessory strap 12 between the first and second ends 16*a*, 16*b* of the accessory strap 12. The method may include pulling the at least one of the first and second ends 16*a*, 16*b* of the accessory strap 12 around a respective at least one of the first and second portions 102*a*, 102*b* of the footwear 100 after folding the first and second ends 16*a*, 16*b* of the accessory strap 12 around the first and second portions 102*a*, 102*b* of the footwear 100 until the accessory strap 12 contacts the foot. The method may also include securing the at least one of the first and second ends 16*a*, 16*b* of the accessory strap 12 between the first and second ends 16*a*, 16*b* of the accessory strap 12 after the accessory strap 12 contacts the foot with a desired tension. In an example in which the first and second attachment mechanisms 14*a*, 14*b* are double-sided pressure-sensitive adhesive tape 140*a*, 140*b*, the method may include applying pressure of greater than a given threshold in order to secure the first and second ends 16*a*, 16*b* to the accessory strap 12 between the first and second ends 16*a*, 16*b* thereof. In such an example, the method may also include removing first and second release liners 22*a*, 22*b* from the first and second attachment mechanisms (such as adhesive 140*a*, 140*b*) prior to securing the first and second ends 16*a*, 16*b* to the accessory strap 12 between the first and second ends 16*a*, 16*b* thereof.

The present invention is not to be limited to the embodiments shown herein and is intended to include all alternatives, modifications, and equivalents as can be included within the spirit and scope of the following claims. Any feature or combination of features described herein is included within the scope of the present invention.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the present claims.

What is claimed is:

1. A method for holding backless footwear on a person's foot, the method comprising:

providing the footwear;

providing an elongated seamless accessory strap, the accessory strap extending in a longitudinal direction from a first end to a second end and having first and second attachment mechanisms disposed on the first and second ends of the accessory strap, respectively;

folding the first end of the accessory strap around a first portion on a first lateral side of the footwear and securing the first end to the accessory strap between the first and second ends thereof by way of the first attachment mechanism; and folding the second end of the accessory strap around a second portion on a second lateral side of the footwear and securing the second end to the accessory strap between the first and second ends thereof by way of the second attachment mechanism;

wherein the accessory strap is a thermoplastic polyurethane film; and wherein the first and second attachment mechanisms are double-sided pressure-sensitive adhesive tape that cannot be removed from the first and second ends of the accessory strap, and the method further comprises:

applying pressure of less than a given threshold to secure at least one of the first and second ends to the accessory strap via a respective at least one of the first and second attachment mechanisms, wherein the at least one of the first and second attachment mechanisms is thereafter releasable from the accessory strap;

placing a person's foot in the footwear and testing the fit of the accessory strap until a desired fit is obtained on the person's foot; and thereafter applying pressure of greater than the given threshold in order to permanently secure both the first and second ends to the accessory strap between the first and second ends thereof.

2. The method of claim 1, wherein the first and second portions of the footwear comprise left and right straps of the footwear.

3. The method of claim 2, further comprising folding the first end of the accessory strap around a rear portion of the left footwear strap and folding the second end of the accessory strap around a rear portion of the right footwear strap.

4. The method of claim 1, further comprising removing first and second release liners from the first and second attachment mechanisms prior to securing the first and second ends to the accessory strap between the first and second ends thereof.

5. The method of claim 1, wherein the accessory strap has a width defined perpendicular to the longitudinal direction, and the first and second attachment mechanisms each have a width that does not exceed the width of the accessory strap.

6. The method of claim 1, wherein the accessory strap is clear.

7. The method of claim 1, wherein the accessory strap is a polyester thermoplastic polyurethane film.

8. The method of claim 7, wherein the accessory strap is 90A Shore A polyester thermoplastic polyurethane film.

9. A method for holding backless footwear on a person's foot, the method comprising:

providing the footwear;

providing an elongated seamless accessory strap, the accessory strap extending in a longitudinal direction from a first end to a second end and having first and second attachment mechanisms disposed on the first and second ends of the accessory strap, respectively;

folding the first end of the accessory strap around a first portion on a first lateral side of the footwear and securing the first end to the accessory strap between the first and second ends thereof by way of the first attachment mechanism; and folding the second end of the accessory strap around a second portion on a second lateral side of the footwear and securing the second end to the accessory strap between the first and second ends thereof by way of the second attachment mechanism;

wherein the accessory strap is 90A Shore A polyester thermoplastic polyurethane film having a thickness of 1/16 of an inch; and wherein the first and second attachment mechanisms are double-sided pressure-sensitive adhesive tape that cannot be removed from the first and second ends of the accessory strap, and the method further comprises:

applying pressure of less than a given threshold to secure at least one of the first and second ends to the accessory strap via a respective at least one of the first and second attachment mechanisms, wherein the at least one of the first and second attachment mechanisms is thereafter releasable from the accessory strap;

placing a person's foot in the footwear and testing the fit of the accessory strap until a desired fit is obtained on the person's foot;

thereafter applying pressure of greater than the given threshold to the first and second ends in order to permanently secure both the first and second ends to the accessory strap between the first and second ends thereof; and thereafter cutting the accessory strap to remove the accessory strap from the footwear.

* * * * *